United States Patent [19]

Dougherty

[11] 4,057,170

[45] Nov. 8, 1977

[54] CARGO CONTAINER DOOR CONSTRUCTION

[76] Inventor: Robert S. Dougherty, Upper Ames Ave., Ross, Calif. 94957

[21] Appl. No.: 716,700

[22] Filed: Aug. 23, 1976

[51] Int. Cl.[2] ..... B65D 45/28; B65D 51/18

[52] U.S. Cl. ..... 220/323; 220/1.5; 49/368; 292/218; 220/72

[58] Field of Search ..... 220/1.5, 71, 72, 323; 49/367-369, 394, 395; 292/218, DIG. 32

[56] References Cited

U.S. PATENT DOCUMENTS

| | | | |
|---|---|---|---|
| 3,132,893 | 5/1964 | Herr et al. | 49/368 X |
| 3,891,112 | 6/1975 | Lycett et al. | 220/1.5 |

*Primary Examiner*—George T. Hall
*Attorney, Agent, or Firm*—Owen, Wickersham & Erickson

[57] ABSTRACT

A cargo container door construction is disclosed. The construction utilizes a relatively thin sheet metal door skin having a plurality of formed-in longitudinally extending stiffener grooves, with the door edge parallel to the grooves being formed into stiffener edges comprising a lip with a recess on its inner side. One such edge supports hinges which connect with a surrounding frame of a cargo container. The two remaining edges of each door lying perpendicular to the grooves, are each stiffened by an elongated bar and plate which are welded continuously to the edge of the skin and which form closed end walls on the grooves. The bar and plate establish edges which are similar to the lip and recess formed edges and the sides of the door, so that a uniform peripheral edge results. The lip and recess at each edge seat a gasket for sealing the door or pair of doors with a cargo container frame. Longitudinally-extending locking bars, which engage with the container frame, are mounted near the stiffener grooves to withstand closure stresses.

8 Claims, 7 Drawing Figures

CARGO CONTAINER DOOR CONSTRUCTION

BACKGROUND OF THE INVENTION

The invention relates to door structure for transportable cargo containers such as those which may be used on ships, rail lines, and trucks. More particularly, the invention relates to an improved cargo container door which is light in weight and economically manufactured, but which has high strength and durability in service.

Cargo container doors have often included a relatively heavy metal outer panel, or a lighter panel with some form of stiffening attached to the inside or outside surface. The stiffeners often took the form of elongated metal sections, U-shaped in cross section, which were welded along their edges to a surface of the panel. While generally supplying the required stiffness, these stiffener members required a high number of welds. They also demanded a large quantity of material and occasioned the occurrence of many interior, inaccessible cavities and niches where moisture would be retained and rust would collect. At the door edges, this type of door often had some form of tubular frame, which also added to the problem.

Prior container door constructions, including the types described above, were considerably heavier and more costly than the construction of the present invention described below, while being no stronger than the present construction and actually being less durable, due to the tendency for rust to occur.

Summary of the Invention

The present invention provides a cargo container door construction which is light in weight, easily and economically manufactured, and of high strength and durability in service.

The door includes a thin sheet metal "skin" which is formed into a plurality of parallel grooves or corrugations extending longitudinally from its upper edge to its lower edge. Also, the two vertical edges which are parallel to the corrugations are each stiffened by formation into a generally rectangular lip, the outer surface of which is coextensive with the outer surface of the skin, and a right-angle recess on the inner side of the lip, with a short flange extending from the edge of the recess parallel to the outer skin surface. The corrugations preferably extend inward from the door surface, and the lip-and-recess edge structure is of the same depth as the corrugations. The corrugations and formed edge structure greatly stiffen the door. In particular, the corrugations may provide local stiffness and stress resistance for the area where a locking bar type door latch is mounted, extending vertically from the upper to the lower edge of the door. Each of these rotatable locking rods may be mounted directly adjacent to a corrugation. The stiffened edge structure provides a strong area for the mounting of hinges which connect to the container frame at one edge of the door, and also provides needed stiffness and strength at the other, openable door edge which may close adjacent to the edge of an opposite-mounted similar such door.

At the upper and lower edges of the door, where the corrugations and formed side edges terminate, stiffener members are welded to the edge of the skin and extend throughout the length of these door edges. Each stiffener member may comprise an elongated bar and plate which form at the upper and lower edges a lip and recess externally identical to those of the side edges. These stiffeners not only cooperate with the corrugations and formed edges to create a rigid, high-strength box-like top and bottom edge structure, but also form end walls that close off the open ends of the corrugations. This enables the inside of the cargo container to be sealed from the outside via the lipped edges, while still leaving the corrugations open at one face so as not to trap moisture and cause rust and other problems.

For the sealing of the door against the cargo container frame, an H-section gasket is readily received and attached onto the edge lips. The manner in which the gasket is received avoids lapped surfaces, which, like other closed-in spaces, would increase the tendency and severity of rust to form. In a double door assembly a gasket is mounted on each of the adjacent central door edges, for sealing the space between the doors. These gaskets are also effectively retained by the lip and recess edge structure.

In a racking test of a pair of container doors constructed according to the invention, the doors exhibited extremely high durability, undergoing deflection but returning to the original shape when loading was removed. The corrugations and the thin sheet metal skin helped maintain strength and preserve structural integrity.

It is therefore among the objects of the invention to provide a cargo container door construction which is light in weight but yet of high strength and durability in service, which involves few components and is economically manufactured, and which through its edge construction, avoids lapping and faying surfaces entirely, greatly reducing rust and other moisture-related problems which have significantly and adversely affected prior door constructions. These and other objects, advantages, and features of the invention will become apparent from the following description of a preferred embodiment, taken in conjunction with the accompanying drawings.

DESCRIPTION OF THE PREFERRED EMBODIMENTS

Figure 1:
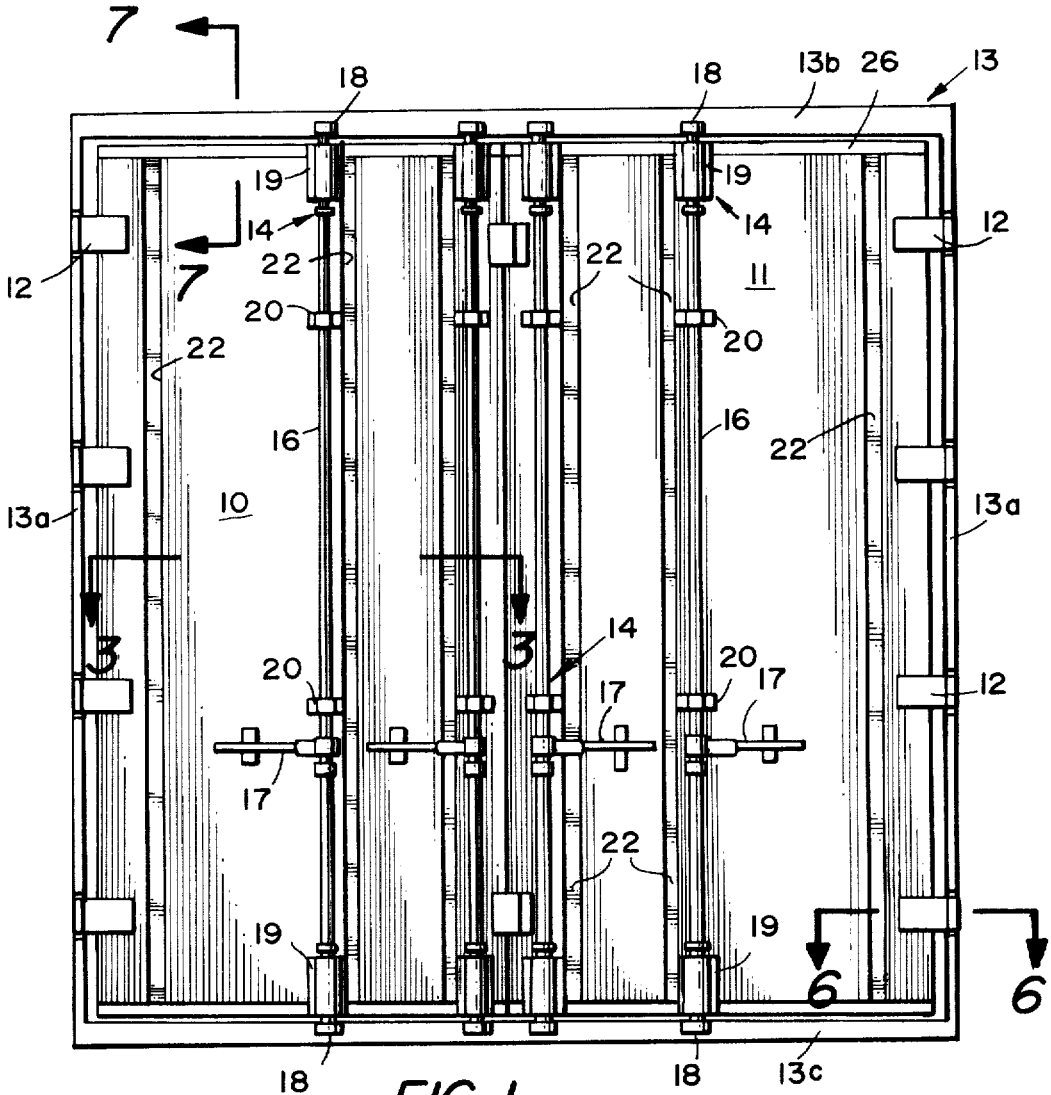
FIG. 1 is a frontal elevational view showing a pair of cargo container doors according to the invention, mounted on a peripheral frame which may form a part of the cargo container.

In the drawings, FIG. 1 shows left and right cargo container doors 10 and 11 connected by hinges 12 to a peripheral frame 13 which may be integral with a cargo container or may be fabricated separately for assembly with the container doors 10 and 11 prior to being attached to the cargo container itself. The frame 13 includes side uprights 13*a*, a header 13*b*, and a threshold 13*c*.

As indicated, the latching of the doors with the frame 13 is preferably accomplished by locking bar type door latches 14, each of which includes an elongated rotatable rod 16 extending from top to bottom of the door, a lever 17 affixed to the rod for latching and unlatching the door, and a cam-action type lock 18 affixed at each end of the rod 16 for latching with a bracket (not shown in detail) on the frame 13. Such door latches are well known and have been used on many other types of cargo container doors. Each latch assembly 14 is affixed to a door 10 or 11 by a series of guide brackets 19 and 20 which may be welded or affixed by fasteners to the surface of the door.

As illustrated in FIG. 1, each locking bar type door latch is mounted on a door 10 or 11 directly adjacent to a longitudinal groove or corrugation 22 in the door, forming an important feature of the invention. The corrugations 22, of which there may be three or more in each door as shown, are formed into the surface of the door, preferably extending inwardly. They act to greatly increase the strength and rigidity of the door, particularly in the areas of the latch assemblies 14 and of the hinges 12, while remaining open on one side so that moisture is not trapped and rust occurrence is greatly diminished. The corrugations 22 shown in FIG. 1 are placed in locations where the greatest stresses on the door have been found to occur during latching and during transit of a heavy load pressing against the doors from inside. As will be discussed below, the corrugations 22 of each door coact with the door edge structure to provide a door of high strength, durability, and structural integrity, utilizing relatively thin sheet metal for the surface.

Figure 2:
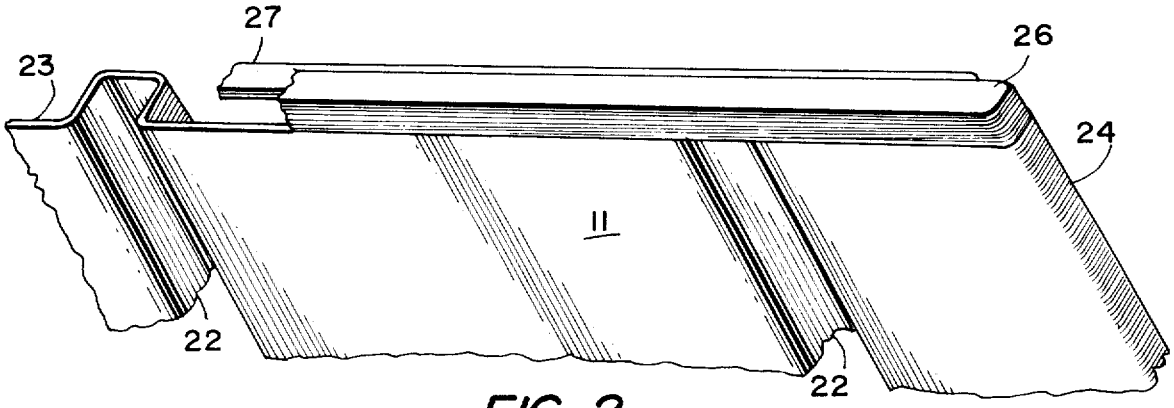
FIG. 2 is a perspective view showing an upper edge of one of the container doors, also showing a portion of a side edge.

The perspective view of FIG. 2 shows a portion of a door including a corner, which may be the upper-right corner of the door 11, although all other corners are similar. The formed portion or "skin" 23 is of light gauge metal, but is greatly reinforced by the corrugations 22 and the edge structure. The skin may be, for example, sheet steel of about 12 guage for a door of 44 inches by 90 inches. At the side (right) edge of the door, the sheet metal skin 23 is formed, in generally right-angular bends, into a lip 24, with a recess involving several additional right-angle bends (not shown in FIG. 2) lying just inside the lip. Onto the upper edge of the skin 23, of the same depth as that of the lip 24, is continuously welded a metal bar 26. The bar 26 is continuous across the top and bottom edges of the door, extending from lip to lip, but is shown broken in FIG. 2 so that other details of the door can be illustrated. Beside the bar 26 toward the inside of the door is a continuous plate 27, only a portion of which is seen in FIG. 2. The plate and bar together make up a depth equal to that of the corrugations 22, thus forming a closed end of each corrugation, while at the same time forming a lipped and recessed top (and bottom) edge which is externally identical to the side edges, as will be explained below.

Figures 3, 4, 5, 6, 7:
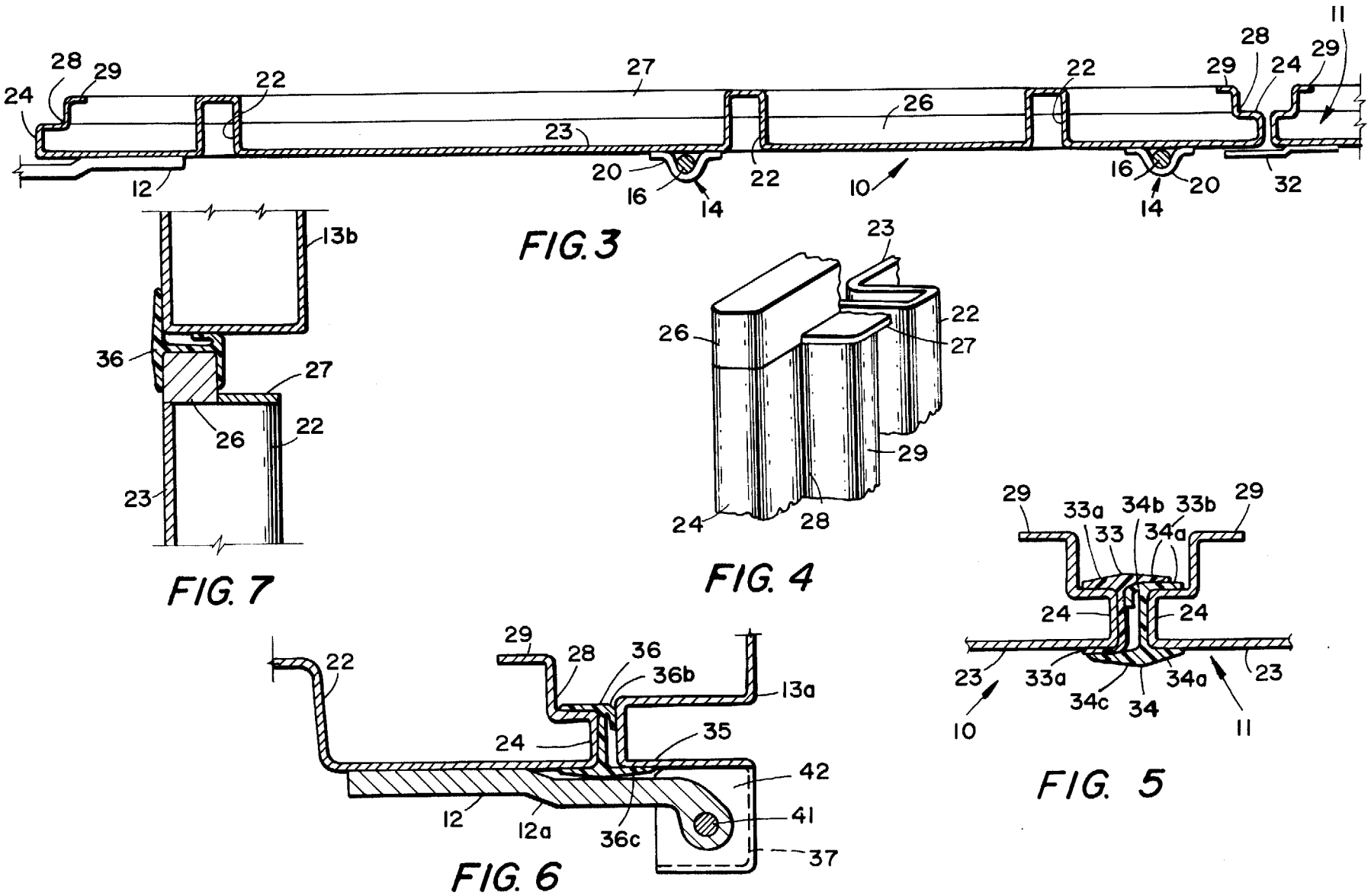
FIG. 3 is a sectional plan view taken along the line 3—3 of FIG. 1, showing one container door and a portion of another.
FIG. 4 is a perspective view showing an upper corner of a door where the top edge and a side edge meet, viewed from a rearward angle.
FIG. 5 is a sectional plan view showing the adjacent vertical edges of the two container doors and a manner in which the pair of gaskets are connected to the edges for sealing the container in this area.
FIG. 6 is an enlarged sectional plan view taken along the line 6—6 of FIG. 1, showing a side edge of a container door and its hinge connection and sealed engagement with a side portion of a frame connected to the cargo container.
FIG. 7 is an enlarged sectional elevation view taken along the line 7—7 of FIG. 1, showing the top edge of a container door and its sealed engagement with a header of the frame.

FIGS. 3 and 4 show the formed shape of the door skin 22 and the configuration of the bar 26 and plate 27 on the upper or lower edge of the skin. As shown in FIG. 3, inside each edge lip 24 is a recess 26 formed by further bends in the skin, and a terminal flange 29 which extends parallel to the front surface of the skin and toward the nearest groove or corrugation 22. Thus the skin steps inwardly from its outer plane in two generally right-angled steps. The first step forms the lip 24, and the second step forms the recess 26 and flange 29. The total depth of each edge is preferably the same as that of the grooves 22, as illustrated.

The bar 26 is positioned on the skin edge as shown in FIG. 4, being equal to the depth of the lip 24, and the striplike plate 27 extends along side the bar 26 from one recess 28 to the opposite recess. The depth of the plate 27 is preferably equal to that of the recess, so that it extends from the lip 24 to the terminal flange 29 as shown. The bar 26 and plate 27 may be of approximately equal depth, each being about half the total depth of the door.

As FIG. 4 indicates, the bar and plate, which may be two separate components welded together or may comprise one unitary element, close off not only the hollow space formed in the skin by the lip 24, recess 28, and terminal flange 29, but also close off the ends of each corrugation 22. This establishes a uniform edge around the periphery of the door, and enables it to be sealed all around by the lip and recess. Thus, the formed shape of the sheet metal skin 23 does not cause any special sealing problems. The bar and plate are preferably welded continuously to the edge of the skin so that the cargo container can be effectively sealed.

The bottom edge of the door is the same as the top edge, with the welded bar and plate construction, and the two side edges are also identical to one another.

FIG. 3 showns the cargo container door 10 and a portion of the door 11 in sectional view, indicating the relative locations of various components. The bottom bar and plate 26 and 27 of each door are shown beyond, while the skin 23 and the rods 16 of the door latch assemblies 14 are shown in cross-section. At the left side of the door 10, each of the hinges 12 is connected to the sheet metal skin 23 preferably by welding, but rivets, lock bolts, or other fasteners may also be used. As illustrated, the hinge connection is in a strong area of the skin, between the stiffened left edge with its lip 24, recess 28 and flange 29, and an adjacent corrugation 22. Thus, the hinge connection, where many stresses collect, has the benefit of both of these stiffening formations in the skin 23. In addition, the bar and plate 26 and 27 add stiffness at top and bottom.

As discussed above, the door latch assemblies 14 are also positioned to take advantage of the formed-in stiffness of the sheet metal skin 23. The central latch assembly 14 is positioned in close proximity to a corrugation 22, while the right-edge latch assembly is positioned between another corrugation 22 and the right-side stiffener edge with its lip 24, recess 28, and flange 29.

FIG. 3 also shows, at the line of juncture of the two doors 10 and 11, a door closure plate 32 welded to the door 11 and extending a short distance over the front of the door 10. Two such plates 32 are preferably provided, as indicated in FIG. 1, their purpose being to assure that the left door 10 is closed before the right door 11, so that the doors will properly seal together by means of a pair of gaskets 33 and 34 which are shown in FIG. 5 but are removed from FIG. 3 for clarity.

As indicated in FIG. 5, the preferably elastomeric gaskets 33 and 34 each have a generally U-shaped portion 33*a* and 34*a* for grasping onto the edge lips 24 of the two doors, where they may be further secured by adhesive. In addition, the left-door gasket 33 includes a flange 33*b* which projects toward the door 11 along the depth of the inner side of the lip. This flange is of a pliable material like the rest of the gasket 33 and like the gasket 34. The gasket 34 includes a leftward-extending flange 34*b* (shown deflected by the gasket 33 in FIG. 5) which, together with the U-shaped portion 34*a*, cooperates with the flange 33*b* to form a seal between the two closed doors. In addition, the gasket 34 includes a heavy flange 34*c* at the front surface of the door 11, extending toward the door 10. This flange cooperates with a portion of the U-shaped part of the gasket 33 to form a second seal between the doors when they are closed, as shown in FIG. 5. Thus, when the doors 10 and 11 are closed properly, an effective double seal is formed between them. The door closure plates 32 assure this proper closure.

The gaskets 33 and 34 may be identical H-shaped gaskets, but with the gasket 33 modified by removal of an outer flange corresponding to the flange 34*b*. This flange is eliminated to prevent interference with its inside-positioned counterpart 34*b*, particularly upon opening of the door 11.

FIGS. 6 and 7 illustrate the manner in which the side edges and top and bottom edges seal with the container frame 13, respectively. In FIG. 6, showing the hinge edge of a door in plan section, an H-shaped elastomeric gasket 36 similar to the gasket 34 is shown mounted on the lip 24 with an inner flange 36*b* deflected against the side frame upright 13*a* and an outer flange 36*c* engaged against an outer surface of the upright 13*a*. A double seal is thus formed. The frame upright 13*a* may include a corrugation 35 to provide the appropriate sealing surfaces.

As also shown in FIG. 6, each hinge 12 may be connected to the frame 13 by a hinge pin 41 connected into a pair of plates 42, one of which is seen in FIG. 6. The plates 42 are preferably welded into interruptions in a forwardly-protruding formed edge 37, shown in dashed lines below the plate 42 in FIG. 6. As indicated, the hinge 12 is offset at 12*a* to provide room for the gasket 36.

FIG. 7 shows the manner in which the top and bottom edges of each door 10 and 11 seal with the cargo container. Only the header 13*b* is illustrated, but the sealing connection of the threshold 13*c* is similar. As in the case of the side seals, the top and bottom seals utilize an H-shaped elastomeric gasket 36, forming a double seal as shown.

The side, top and bottom, and between-the-door gaskets may be mitered at corners (not shown) and bonded together.

As mentioned above, doors constructed according to the invention were subjected to a racking test. Mounted in a frame similar to the frame 13, the doors were closed and latched and subjected to a side loading, from the top left, of 33,000 pounds. The load was applied to the frame, and the frame was anchored at its left and right bottom corners. Under loading the doors deflected, but snapped back to their normal configuration when the load was removed. The corrugations 22 on either side of the latch assemblies proved to maintain high strength and to preserve structural integrity.

A very important feature of the doors 10 and 11 of the invention is that they contain no closed-in or hollow spaces, and their construction even avoids lapped metal surfaces and faying surfaces, which would result in closed inaccessible spaces. The principal advantage of this construction, in addition to saving material, is that every surface of the assembled door is accessible and can easily be coated with paint or other rust-proof coating. In contrast, doors which employ tubing at edges, U-shaped welded-on stiffeners, or lapped and faying surfaces, are inevitably subject to rust and corrosion from within because not all their surfaces may be protected.

The above-described preferred embodiment provides a cargo container door construction which is very economical of labor and materials in manufacture and which avoids complex structure and multitudinous niches which would collect rust and promote deterioration, while still being of high strength, rigidity, and structural integrity, making the doors very dependable in service. Various other embodiments and alterations of this preferred embodiment will be apparent to those skilled in the art and may be made without departing from the spirit and scope of the following claims.

I claim:

1. A cargo container door, comprising:

a formed sheet metal skin having a plurality of formed corrugations extending vertically from top to bottom, and having left and right vertically extending edges formed into an outer lip with a recess at the inner side of the lip;

a stiffener bar welded onto each of the upper and lower edges and extending throughout the width of the door, said bar being of approximately the same inside-to-outside thickness as, and generally flush with, the left and right edge lips; and means forming closed off ends on the corrugations at the upper and lower edges;

whereby a generally uniform lipped edge is provided around the periphery of the door for receiving a sealing gasket, the upper and lower edges are sufficiently stiff to provide a sturdy door construction with a relatively thin sheet metal skin, and all surfaces of the door are open and accessible.

2. The cargo container door of claim 1 wherein the corrugations in the sheet metal skin are generally rectangular in cross section and extend inwardly from the surface of the door.

3. The cargo container door of claim 1 wherein each of the left and right edges comprises a doubly stepped formation in the sheet metal, with a first generally right-angled step forming said outer lip and a second generally right-angled step extending from the end of the first and forming said recess at the inner side of the lip.

4. The cargo container of claim 3 wherein the corrugations in the sheet metal skin extend inwardly from the surface of the door to a depth approximately equal to that of said second right angled steps, and said closed off end means comprises an elongated plate welded to each of the upper and lower edges, abutting against and welded to said bar and extending from said second right-angled step of the left edge to that of the right edge, whereby the plate adds rigidity and strength to the edge and, in cooperation with the bar, forms an end wall on each corrugation so that the upper and lower door edges can be sealed with a container body.

5. The cargo container of claim 1 wherein the door includes a plurality of rotatable rod type cam-action door locks engageable with a frame of the cargo container which lies adjacent to the door edges, said door locks extending vertically over and mounted onto the door surface, and wherein each lock is positioned adjacent to one of the corrugations, so that the door resists bending stresses in the vicinity of the locks.

6. A cargo container door, comprising:

a generally planar sheet metal skin having a plurality of parallel, formed grooves extending vertically from top to bottom, and having left and right side vertical edges formed into an outer, peripherally-extending lip with a recess at the inner side of the lip; and metal stiffening means welded to each of the upper and lower edges of the skin and forming a closed end wall on each of the grooves, said stiffening means being shaped to form at the upper and lower door edges a lip and recess similar to that of the side edges.

7. A pair of cargo container doors according to claim 6 arranged generally coplanarly with side edges adjacent, and with a cargo container frame peripherally surrounding the two doors, each door being hinged to the container frame along its outside vertical edge, and a generally H-shaped gasket retained on each edge lip of each door, except on one of the adjacent door side edges, where the front protruding flange of the H-shaped gasket is removed.

8. The cargo container door of claim 6 wherein the stiffening means comprises an elongated solid metal bar and plate member having exterior shape similar to that of the side edges, whereby the door construction avoids closed-in and hollow spaces, every surface of the door being accessible for coating.

* * * * *